US005238161A

United States Patent [19]

Kimishima

[11] Patent Number: 5,238,161

[45] Date of Patent: Aug. 24, 1993

[54] DEVICE FOR HOLDING A GLASS

[76] Inventor: Takiko Kimishima, 4-12, Showa 2-chome, Utsunomiya-shi, Tochigi-ken 320, Japan

[21] Appl. No.: 798,589

[22] Filed: Nov. 26, 1991

[30] Foreign Application Priority Data

Nov. 30, 1990 [JP] Japan ..... 2-130190[U]
Sep. 2, 1991 [JP] Japan ..... 3-078143[U]

[51] Int. Cl.[5] ..... A45F 5/00

[52] U.S. Cl. ..... 224/217; 224/148; 224/218; 224/906; 220/737; 220/738; 229/1.5 H

[58] Field of Search ..... 224/217, 148, 218, 251, 224/906; 220/737, 738, 914; 229/1.5 H, 117.13

[56] References Cited

U.S. PATENT DOCUMENTS

| | | | |
|---|---|---|---|
| 2,085,661 | 6/1937 | Janowski | 220/737 X |
| 2,916,180 | 12/1959 | Alger | 220/737 X |
| 3,104,788 | 9/1963 | Wood | 229/1.5 H |
| 3,596,795 | 8/1971 | D'Ercoli | 220/738 X |
| 4,461,412 | 7/1984 | Langland | 224/273 |
| 4,606,523 | 8/1986 | Statz et al. | 220/737 X |
| 4,620,631 | 11/1986 | Bartelt | 220/737 X |
| 4,685,583 | 8/1987 | Noon | 220/94 R |
| 4,728,018 | 3/1988 | Parker | 224/273 |
| 4,981,217 | 1/1991 | Lim | 224/906 X |
| 5,119,967 | 6/1992 | Ercolani | 220/23.6 |

FOREIGN PATENT DOCUMENTS

| | | |
|---|---|---|
| 56-67086 | 6/1981 | Japan . |
| 58-55576 | 4/1983 | Japan . |
| 63-68857 | 5/1988 | Japan . |
| 63-124873 | 8/1988 | Japan . |
| 2-96958 | 8/1990 | Japan . |

*Primary Examiner*—Allan N. Shoap
*Assistant Examiner*—Vanessa Caretto
*Attorney, Agent, or Firm*—Brooks Haidt Haffner & Delahunty

[57] ABSTRACT

The glass holding device comprises a cylindrical portion (1) and a bottom portion (2), and the cylindrical portion (1) is provided with a hole (3) for inserting a finger of a user. The glass holding device is made of a sheet material, which is water proof, flexible and capable of being holded. The glass holding device is very inexpensive, and accordingly, it may be disposable. It can be stored after it is fabricated while it is folded and stacked one over the other. Thus, the space for storing the device can be minimum. A user using the glass holding device can simultaneously carry a glass and a plate for meal by his or her single hand during a stand-up dinner party. The glass holding device is applicable for holding various types of glasses.

10 Claims, 3 Drawing Sheets

DEVICE FOR HOLDING A GLASS

BRIEF DESCRIPTION OF THE INVENTION

The present invention relates to a device for holding a glass which is mainly used at a stand-up dinner party.

Recently stand-up dinner parties are widely held with various events. During such stand-up dinner parties, it is common for persons attending at the parties to walk around while they carry glasses and plates. However, in order to place food on the plate or to eat the food on the plate, he or she has first to set down the glass to free a hand, which is inconvenient. Further, there is another inconvenience wherein a glass which has been temporarily put on a table cannot be distinguished from another glass which has been used by another person.

In order to avoid such inconveniences, plates with holes for holding glasses have been proposed. For example, they are disclosed in Japanese Utility Model Applications Laid-open No. Sho 56-67086, No. Sho 58-55576 and No. Sho 63-68857.

Each of the above-described plates is a relatively large plate of a tray type, and it has a hole for inserting a glass formed at a portion thereof. The plate is further provided with another hole for inserting a thumb in addition to the hole for inserting the glass. Thus, the plate is supported by a user's thumb inserted into the latter hole, like a palette for painting is supported by a painter.

However, the plates are expensive since they have to be manufactured in specially designed shapes. Further, when they are used, the thumbs of the users have to bear large weights since the plates per se have large weights, and in addition, food and drink are also born by the thumbs. Thus, the users cannot endeavor for use of such plates for a long time. Furthermore, the plates cannot be used for holding all types of glasses but only specific glasses which have upper portions wider than bottom portions because only holes without bottoms are formed on the plates.

Alternatively, Japanese Utility Model Application Laid-open No. Sho 63-124873 discloses a device for holding a glass wherein a ring shaped glass holding portion is provided with a portion for engaging with a finger. However, this glass holding device cannot be used for some types of glasses. Further, a finger supports the glass while it is inserted into the finger engaging portion in the glass holding device. Thus, the balance of the glass may be adversely affected by the weight of liquid poured therein, and thus, there is a fear that the glass may turn over. It is very difficult for a user to hold well both a glass, which may be unbalanced as described above, and a plate. The glass holding device cannot be stacked, and a large space is required for storing such glass holding devices.

In order to overcome the inconveniences inherent to the above-described prior art, the present inventor previously proposed a device for holding a glass of an assembled type in Japanese Utility Model Application Laid-open No. Hei 2-96958.

The previously proposed glass holding device of an assembled type is made of a single plate-like material when it is developed. The plate-like material is stiff but it can be bended. The glass holding device has a slit formed at a lower edge of a portion to be a cylindrical portion for supporting a side periphery of a glass, and a projection formed at a portion to be a bottom portion. When the glass holding device is assembled by engaging the projection with the slit, the cylindrical portion and the bottom portion for supporting the glass are formed.

The glass holding device disclosed in the above-described Japanese Utility Model Application Laid-open No. Hei 2-96958 has to be assembled whenever it is used, and thus this assembling operation is troublesome. Further, this assembling operation needs a relatively long time when a person is not accustomed with such an assembling operation. Accordingly, it is preferable for the device to have been assembled before it is used. However, once the device has been assembled, there is a problem that a large space is required for storage since the assembled devices cannot be stacked. In addition, a plate of a synthetic resin with about 0.7 mm thickness is used for the device in order to enhance the stiffness of the device, a user may suffer from pain on his or her finger when he or she uses the device for a relatively long time.

OBJECT OF THE INVENTION

The present inventor practically confirmed that a device for holding a glass has to satisfy the conditions that any assembling operation of the device can be omitted upon use, that the cost for producing the device is inexpensive, and that the space for storing the devices can be minimum. Further, it is preferred that the strength of the device will not be reduced even when it is wet so that the device can be used for beer, and that the weight of the device per se is light enough that a finger supporting the device will not be distressed.

It is an object of the present invention to provide a device for holding a glass, which device can be stored after it has been fabricated, which device requires only a minimum space for storage, and the cost of which device is inexpensive.

SUMMARY OF THE INVENTION

According to the present invention, the above-described object is achieved by a device for holding a glass comprising a cylindrical portion and a bottom portion, the cylindrical portion being provided with a hole for inserting a finger, wherein the glass holding device is made of a sheet material which is water proof, flexible and capable of being folded.

The device for holding a glass according to the present invention is in a fabricated condition, and therefore, assembling operation can be omitted.

Since the device for holding a glass of the present invention is made of a sheet material, which is flexible and which is capable of being folded, the device can be stored while it is folded into two, and accordingly, the space for storing the devices can be small.

Further, according to the present invention, since the device is made of a flexible sheet, of such as a synthetic resin, the device can be manufactured at a very low cost. Since the device is inexpensive, it can be disposed.

The device according to the present invention is made of a water proof sheet, the device will not be broken even when it is wetted, for example, by dew condensation on a glass surface due to pouring cold liquid, such as beer, in the glass held in the device.

In addition, since the device of the present invention is made of a flexible sheet, the user is free from pains on his or her finger.

BRIEF DESCRIPTION OF THE DRAWINGS

The present invention will now be explained in detail with reference to the accompanying drawings, wherein.

PREFERRED EMBODIMENTS

Figure 1:
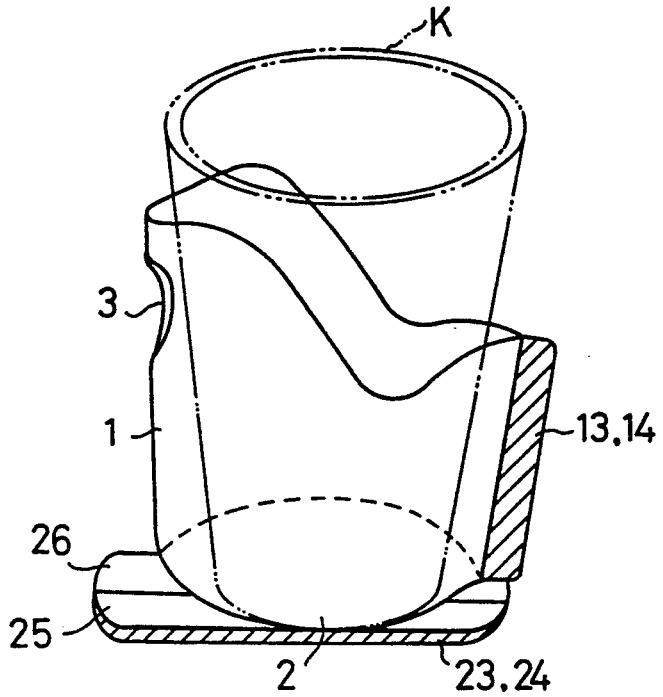
FIG. 1 is a perspective view in use of a first embodiment of a device for holding a glass according to the present invention.

As illustrated in FIG. 1, the device for holding a glass according to the present invention comprises a cylindrical portion 1 for holding the side surface of a glass K and a bottom portion 2 for supporting the bottom of the glass K. The cylindrical portion 1 is provided with a hole 3 for permitting a user to insert his or her thumb therethrough.

The glass holding device of the first embodiment according to the present invention illustrated in FIGS. 1 to 4 is made of a single, flexible and water proof sheet. The material used for the sheet is water proof and flexible. A synthetic resin, such as polyethylene or vinyl, may be used as the sheet, and the sheet may be relatively thick, i.e., the thickness of between about 0.1 mm and 0.5 mm, preferably the sheet having a thickness of between 0.1 mm and 0.3 mm may be used. Further, a sheet obtained by combination of a transparent sheet of a synthetic resin and a sheet formed in lace, for example, a sheet used for a table cloth, is also preferable for the device for holding a glass from the aesthetic point of view. In addition, a paper with water proofing may also be used. However, if the device is periodically used, a sheet of a synthetic resin is superior to that of the paper with water proofing. The sheet of the present invention may be colored or printed, if it is desired.

The sheet material is subjected to a die cutting or shearing operation so that the sheet material is formed in a shape, for example such a shape as illustrated in a developed view of FIG. 2, and then the side edges 13 and 14 are connected to each other in a manner which will be explained below so that a device for holding a glass of the present invention is formed.

Figure 2:
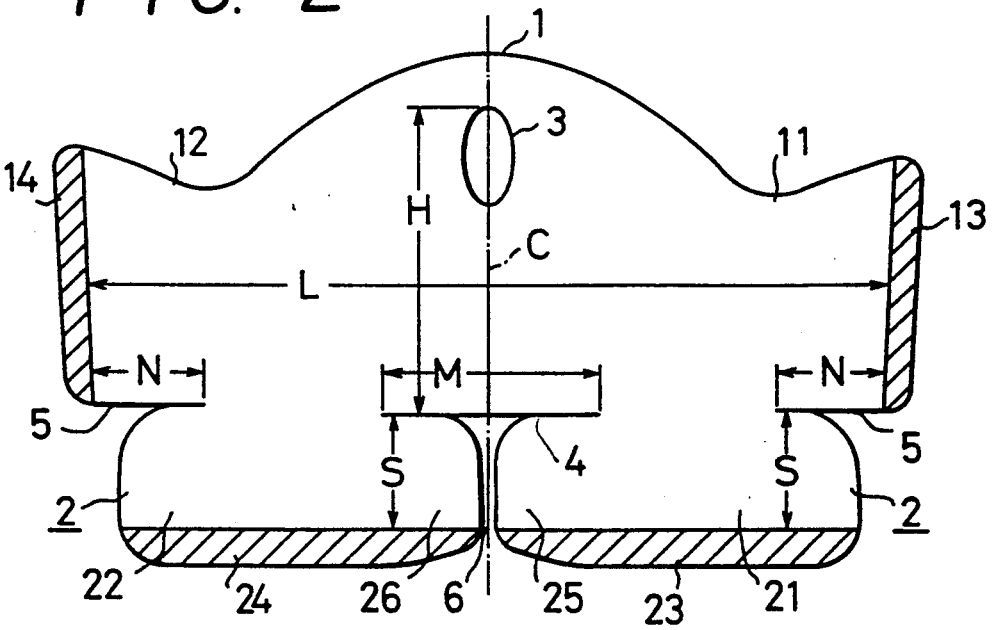
FIG. 2 is a developed view of the device for holding a glass illustrated in FIG. 1.

The device for holding a glass of the illustrated embodiment has a symmetric shape with respect to a central line C as illustrated in the developed view of FIG. 2. A hole 3 for inserting a thumb is formed at the center of the portions 11 and 12 which will constitute a cylindrical portion 1. As illustrated in the developed view of FIG. 2, the portion which will be an upper edge of the cylindrical portion 1 is so formed that it is the highest at the center where the hole 3 for inserting a thumb is formed, and its height is gradually lowered as it moves horizontally away from the central line C and the height is slightly increased again at the lateral sides 13 and 14.

As described above, the intermediate portion of the upper edge of the portions 11 and 12 to be the cylindrical portion 1 is curved in a convex shape so that a glass can be readily grasped by hand since the periphery of the glass at least partially projects above the curved portion when it is inserted into the device.

Furthermore, it has been practically confirmed by the present inventor that a glass which has a diameter slightly larger than the desired one can be easily inserted into the cylindrical portion when the upper edge is curved.

The sides of the portions 11 and 12 to be the cylindrical portion are lateral connecting portions 13 and 14, which are connected to each other. Upon connection, the connecting operation can be done by ultra-sonic sealing, high frequency sealing, heat sealing and so on, or by adhesive. Alternatively, the side edges can be connected to each other by another connecting means.

The portions 21 and 22 which will be a bottom portion 2 are connected to the lower portions of the half portions 11 and 12 of the cylindrical portion 1. The cylindrical portion 1 and the bottom portion 2 are partially divided by a central slit 4 which extends horizontally and lateral slits 5 which also extends horizontally, and two bottom portions 21 and 22 are separated by a vertical slit 6.

Figure 3:
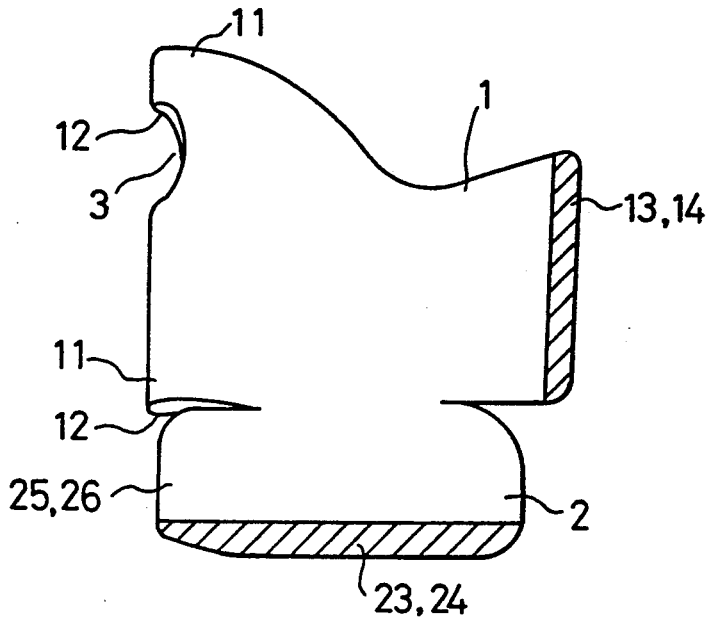
FIG. 3 is a perspective view in a stored condition of the device for holding a glass illustrated in FIG. 2.

In the device for holding a glass of the first embodiment according to the present invention, the sheet illustrated in the developed view in FIG. 2 is folded in two, and the connecting portions 13 and 14 are connected to each other, and the bottom connecting portions 23 and 24 are also connected to each other. In FIGS. 1 to 3, the connecting portions 13 and 14 are indicated by hatching. The peripheral length L of the cylindrical portion 1 is selected taking into consideration the peripheral length of a glass K, which will be used, and allowable tolerance. Further, the height H from the upper end of the hole 3 for inserting a finger to the central horizontal slit 4 is selected to be about a widest width of a palm of a user, which width is measured at around a thumb of the user. In this case, since the sheet is flexible, the height H may be slightly larger or smaller than the palm.

The length N of the lateral horizontal slits 5 is preferably about one half of the diameter of the bottom of the glass K. The width S of the two bottom portions 21 and 22 is preferably about one half of the diameter of the bottom of the glass K.

Figure 4:
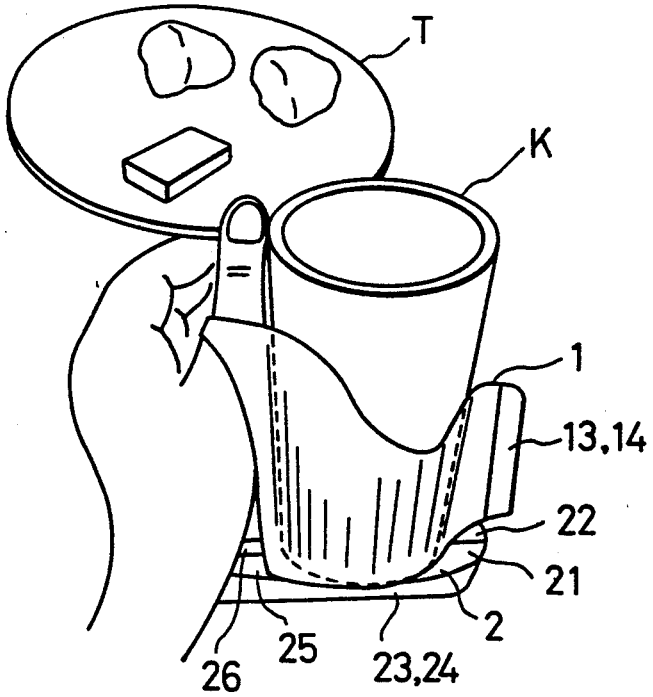
FIG. 4 is a perspective view in a condition wherein the device illustrated in FIG. 1 is supported by a hand.

It is preferred that the ends 25 and 26 of the bottom portions 21 and 22 near the central line C are so designed that they slightly project from the cylindrical portion 1 as illustrated in FIGS. 1 and 4, and that they engage with the palm of the user in use as illustrated in FIG. 4. When the bottom portions 21 and 22 are designed as described above, the glass holding device can be stable since they engage with a side of the palm of the user.

The device for holding a glass according to the present invention can be folded in two before use and can be stored.

Upon use, the upper opening of the cylindrical portion 1 is opened as illustrated in FIG. 1, where a glass K is put, and a thumb of a user is inserted into the hole 3. Then, the bottom of the glass K, which has been put into the cylindrical portion 1, abuts with the bottom portion 2, and accordingly, the bottom portions 21 and 22 of the bottom 2 become substantially horizontal as illustrated in FIGS. 1 and 4. The thumb inserted into the hole 3 may cooperate with another finger so as to grasp a plate T or the like. Thus, the lateral end portions 25 and 26 of the bottom portions 21 and 22 of the glass holding device abut with a side of the palm of the user, and the glass K is stably held.

Although the glass holding device of the present invention was manufactured by connecting the lateral connecting portions 13 and 14 and the bottom connecting portions 23 and 24 after the sheet is die cut in a shape illustrated in the developed view of FIG. 2, a substantially rectangular sheet may be folded in two, then its sides and bottom are sealed, and thereafter, the sheet may be die cut in a shape illustrated in FIG. 3.

Figure 5:
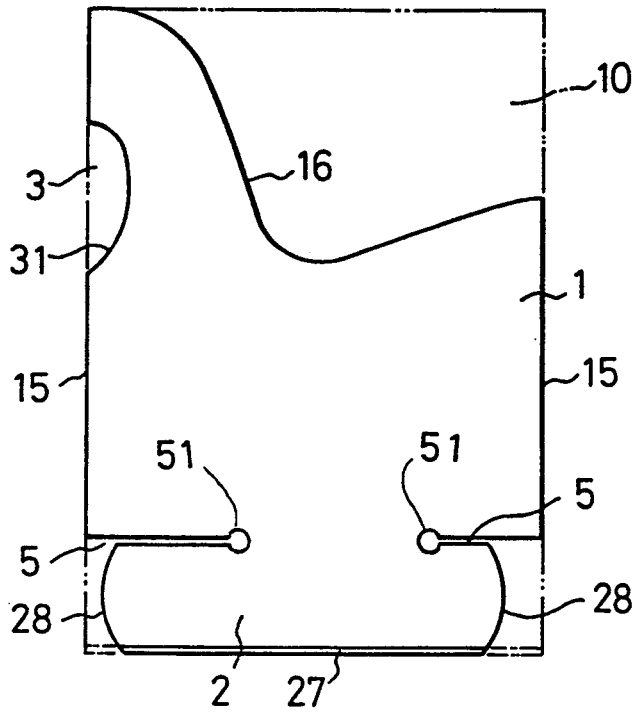
FIG. 5 is a plan view of a second embodiment of a device for holding a glass according to the present invention, wherein the device is folded into two similarly to FIG. 3.
Figure 6:
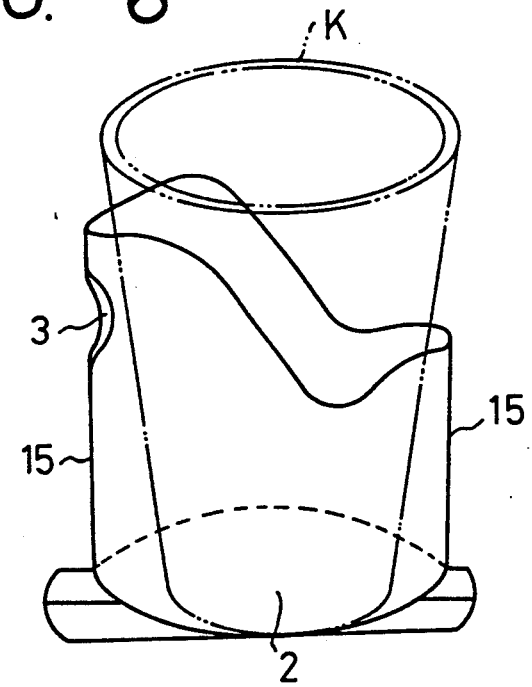
FIG. 6 is a perspective view of the second embodiment of the device for holding a glass, wherein a glass is held in the device of the second embodiment.

FIG. 5 is a plan view of a second embodiment of a device for holding a glass according to the present invention, wherein the device is folded into two similarly to FIG. 3, and FIG. 6 is a perspective view of the second embodiment of the device for holding a glass, wherein a glass is held in the device of the second embodiment.

The glass holding device of the second embodiment is made from a bag 10 formed in a rectangular shape and having a bottom 27. The bag 10 is designated by phantom lines, i.e., two dots and a dash lines in FIG. 5. The sides 15 of the flat rectangular bag 10 form a loop, and die cut 31 is formed at one of the sides whereby a hole 3 for inserting a finger can be made by removing the portion along the die cut 31. Similar to the first embodiment, the upper portion of the bag 10 is cut in a curve 16, which is high in an area near the hole 3 and which is low in an area away from the hole 3. The lower ends of the side, i.e., the area within about 3 cm above the sealed bottom 27, are formed in an arc 28, and the slits 5 are formed from the sides. It is preferred that small circular holes 51 are formed at the inside ends of the slits 5 as illustrated in FIG. 5 whereby the slits 5 can be prevented from being torn at the inside ends. Thus, a glass holding device similar to that of the first embodiment is obtained.

In the second embodiment, cutting operation of the bag 10 with bottom is only required and any specific sealing operation is unnecessary. Accordingly, the device can be manufactured at a low cost. The sheet material can be the same as or similar to that used in the first embodiment. More specifically, the sheet material must be water proof, and flexible. For example, the sheet material may be synthetic resin sheet, such as polyethylene or vinyl and may have a thickness of between about 0.01 mm and 0.1 mm, more preferably, between about 0.05 mm and 0.07 mm. The bag 10 with bottom can be preferably obtained at a low cost by forming a tube by inflation method, and then transversely sealing and cutting at a predetermined interval.

The glass holding device of the second embodiment is substantially the same as that of the first embodiment with respect to the other points.

Since the device for holding a glass of the present invention is made of a sheet material, which is flexible and which is capable of being folded, the device can be manufactured at a very low cost. Since the device is inexpensive, it can be disposed. Especially, when the device is used at an outdoor party, or party held in a park or on a sight-seeing ship, it is very convenient since it can be disposed.

Since the device for holding a glass of the present invention is made of a sheet material, which is flexible and which is capable of being folded, the device can be stored while it is folded into two, and accordingly, the space for storing the devices can be small. Further, the devices for holding a glass according to the present invention can be stored while they are stacked.

Different to the glass holding device which present inventor proposed in Japanese Utility Model Application Laid-open No. Hei 2-96958, assembling operation is unnecessary upon use, every body can readily use the device of the present invention.

In addition, since the device of the present invention is made of a flexible sheet, it is very light, and the user is free from pains on his or her finger even when he or she holds a glass poured with drink. Further, since the weight of the glass is supported between the thumb and the palm near the little finger, a user may feel lighter than usual wherein a glass is held at the ends of the fingers.

The device is formed by a sheet material, and the sheet material can be colored or printed at will, and the color can be selected easily so that device with aesthetic effect can be manufactured.

Since the device of the present invention comprises the cylindrical portion and the bottom portion, it can hold not only a glass with wide opening but also a glass with opening and bottom of the same diameter. In some case, a stemware, i.e., glassware with stem, such as a liqueur glass, can be accommodated.

Using the glass holding device of the present invention, the user can simultaneously hold a glass and a plate in one hand, and accordingly, the other hand is always free from a glass or a plate, and he or she can freely use the other hand for eating a meal or handshaking.

In addition, in place of a glass, snack food may be held in the device of the present invention, and a glass may be held in the other hand.

I claim:

1. A holder which is storable in a flat condition and openable to embrace and support a drinking glass, said holder being constructed of thin highly flexible sheet material and having a body portion and an integral bottom portion, said body portion being in the form of a flattened sleeve having an open top end and which is openable to form a cylinder for receiving and encircling said glass, said bottom portion being joined to said body portion at the end of said body portion that is opposite said open top end and being folded to lie flat with said body portion for storage and to open in response to opening said body portion to provide a bottom for said body portion for supporting said glass at the bottom thereof, and said body portion being provided with a thumb hole adjacent said top end for inserting a thumb to support said holder and glass.

2. A holder according to claim 1, wherein said holder comprises a single sheet of said material folded in half along an imaginary line extending between said ends of said body portion with opposing side edges of said sheet brought together and joined, said bottom portion comprising two panels extending one from each half of said body portion each of said panels having a bottom edge, and said bottom edges of said panels joined together.

3. A holder according to claim 2, wherein the thickness of said sheet material is between about 0.1 mm and about 0.5 mm.

4. A holder according to claim 2, wherein upon opening of said sleeve to receive a glass thereby forming a cylinder from said body portion a part of said bottom portion projects laterally beyond the perimeter of said body portion substantially in line with and on the side of said body portion that contains said thumb hole, said bottom portion projection being sufficient to engage the palm of a hand whose thumb is inserted through said thumb hole.

5. A holder according to claim 4, wherein said open top end of said body portion, commencing at a point over said thumb hole curves downwardly to a low point and then upwardly to an intermediate elevation at a point opposite said commencing point.

6. A holder according to claim 1, wherein said bottom portion of said holder is partially separated from said body portion by respective slits extending only part way across the body portion from each side thereof.

7. A holder according to claim 6, wherein the thickness of said sheet material is between about 0.1 mm and about 0.5 mm.

8. A holder according to claim 6, wherein upon opening of said sleeve to receive a glass thereby forming a cylinder from said body portion a part of said bottom portion projects laterally beyond the perimeter of said body portion substantially in line with and on the side of said body portion that contains said thumb hole, said bottom portion projection being sufficient to engage the palm of a hand whose thumb is inserted through said thumb hole.

9. A holder according to claim 8, wherein said open top end of said body portion, commencing at a point over said thumb hole curves downwardly to a low point and then upwardly to an intermediate elevation at a point opposite said commencing point.

10. A holder according to claim 1, wherein the thickness of said sheet material is between about 0.1 mm and about 0.5 mm.

* * * * *